US006488251B1

(12) United States Patent
Mott

(10) Patent No.: US 6,488,251 B1
(45) Date of Patent: Dec. 3, 2002

(54) MEDIA SUPPORT AND DISPLAY DEVICE, METHOD AND SYSTEM

(76) Inventor: Erick Mott, P.O. Box 1737, Palo Alto, CA (US) 94302

( * ) Notice: Subject to any disclaimer, the term of this patent is extended or adjusted under 35 U.S.C. 154(b) by 0 days.

(21) Appl. No.: 10/082,583

(22) Filed: Feb. 21, 2002

(51) Int. Cl.[7] ..... A47B 97/04
(52) U.S. Cl. ..... 248/459
(58) Field of Search ..... 248/59, 174, 460; 206/762, 45.24, 45.25, 427, 196, 434; 229/117.13

(56) References Cited

U.S. PATENT DOCUMENTS

| | | | | | |
|---|---|---|---|---|---|
| 1,146,895 | A | | 7/1915 | Miller | 222/130 |
| 1,942,456 | A | | 1/1934 | Stark | 211/2 |
| 2,022,865 | A | | 12/1935 | McAdams | 248/460 |
| 2,595,682 | A | | 5/1952 | Lipa | 248/453 |
| 3,408,032 | A | | 10/1968 | Francis | 248/450 |
| 3,954,246 | A | | 5/1976 | Sparkman | 248/453 |
| 4,044,980 | A | | 8/1977 | Cummins | 248/459 |
| 4,343,105 | A | * | 8/1982 | Isaacson | 229/71 |
| 4,610,417 | A | | 9/1986 | Kuss | 248/460 |
| 5,029,798 | A | * | 7/1991 | Clark | 206/45.24 |
| 5,555,991 | A | * | 9/1996 | Hart | 206/45.28 |
| 5,560,692 | A | * | 10/1996 | Smith | 108/100 |
| 6,021,897 | A | * | 2/2000 | Sutherland | 206/196 |

* cited by examiner

*Primary Examiner*—Ramon O. Ramirez
(74) *Attorney, Agent, or Firm*—Haverstock & Owens LLP

(57) ABSTRACT

A media stand in accordance with the instant invention comprises a primary support structure and a secondary support structure. The primary support structure and the secondary support structure are assembled to provide a collective support function in a upright position and assembled to provide a packaging function in a flattened and folded position. In further embodiments of the instant invention, a portion of the media stand provides an avenue for the direct distribution of media content, whereby advertisement, logos, messages or works of art are printed or displayed on one or more portions of the media stand. In accordance with the content distribution system of the invention, advertisement, logos, messages or works of art are printed or displayed on a surface of the secondary support structure which is viewable with the stand assembled in the upright position. Preferably, the content media can be customized by the a media content provider selecting one or more content media formats from an electronic catalog accessible over the internet.

32 Claims, 6 Drawing Sheets

MEDIA SUPPORT AND DISPLAY DEVICE, METHOD AND SYSTEM

FIELD OF THE INVENTION

The present invention relates to the field of display systems. More particularly, the present invention relates to display systems for supporting media or copy.

BACKGROUND OF THE INVENTION

Today, business people, students and readers in general who work on the Internet and with computing and desktop productivity tools, have come to rely on bookstands, copy holders, document holder, herein referred to generally as media stands, to help them organize their work, study and reference areas. With the amount of paper, books and information that they have to deal with, media stands have become invaluable tools in organizing a variety of media content. Some are designed to be small and compact, allowing users to carry them from place to place. This feature is especially appealing to students and mobile workers. Due to its compact size, a portable media stand can usually be stored in a briefcase or school bag and can be taken where ever it is needed. Other media stands are designed to hold large, heavy books and documents, or even computer monitors. However, these types of stands and holders are of significant size, weight and cost and are often attached to the desktop or computer, thus making mobility very difficult.

SUMMARY OF THE INVENTION

Most media stands have limited functionality. In fact most media stands are designed to perform a single function which is to hold or display a book, a document or other type of media object. Also, most media stands come in point-of-purchase packaging that provide protection for the stand during its distribution to customers and/or end users, but provides no continuing benefit to the consumers or the end users and is, therefore discarded after the product is purchased.

What is needed is a method of packaging a product, such as a media stand, whereby the packaging has an "after market" use or benefit to the consumer and/or seller, thereby minimizing the after market environmental impact. Further, what is needed is a portable media stand that includes packaging that enhances the functionality of the media stand and preferably provides a support function for displaying media and content on the stand as well as a packaging function.

Accordingly, the current invention is directed to a media stand which includes a primary support structure and a functional point-of-purchase packaging, herein also referred to as a secondary support structure. The secondary support structure preferably couples to the primary support structure and provides a larger surface area for supporting lager media.

In accordance with further embodiments of the instant invention, the point-of-purchase packaging, or secondary support structure, is configured to deliver media content to the customers or end users. In accordance this embodiment of the instant invention, customers, businesses or stores can purchase a number of pre-packaged media stands which include customized secondary support structures printed with media content, such as advertising, a message or a logo. Accordingly, the packaging design makes it possible for a media content provider to directly distribute their media content to a target audience through the distribution of the media stands.

In accordance with the present invention, the customized and functional packaging can be selected from an electronic catalog accessible over the internet by the media content provider from a remote computer. For example, a customer, a business or a store can place an order for a number of media stands with their advertisement or message printed on the functional packaging, or secondary support structure, whereby the subsequent distribution the media stands to the end users also results in the distribution of the advertisement or message to the end users.

The media stand of the instant invention is preferably configured for supporting media in an upright or viewable position. The media stand can be configured to support or display any number or different media objects including, but not limited to, printed copy, books, art and photographs.

The primary support structure of the media stand preferably comprises a support member and a foot member, whereby the support member and the foot member are configured to be positioned at an angle relative to each other with a media object resting on a frontal face of the support member and with the support member and the foot member secured in an upright support position. The angle between the support member and the foot member of the primary support structure is preferably obtuse such that an media object supported or displayed on the stand can be comfortably viewed while sitting or working at a computer terminal.

The primary support structure preferably further comprises at least one platform or arm structure coupled to the frontal face of the support member for directly supporting the media object. The arm structure is preferably configured such that the angle between the frontal face of the primary support structure and the arm structure is substantially perpendicular.

During use, the primary support structure and the secondary support structure are preferably coupled or integrated. The secondary support structure is preferably formed from a sheet material, such as paper material or plastic, with multiple fold lines and perforations which form multiple panels. To integrate the primary and secondary support structure, the panels wrap around the primary support structure and secure to one or more portions of the primary support structure thereby collectively forming the media stand with a larger support surface area being provide by the secondary support structure.

The secondary support structure preferably comprises a first panel that is adapted to lie adjacent to the frontal face of the primary support structure, while a second panel is adapted fold or wrap over the back of the primary support structure and extend in a direction that is substantially perpendicular with a resting surface to provide additional support for media objects. The second panel also preferably has pleats that fold inward and provide additional structural integrity to the media stand.

DETAILED DESCRIPTION OF A PREFERRED EMBODIMENT

Figure 1:
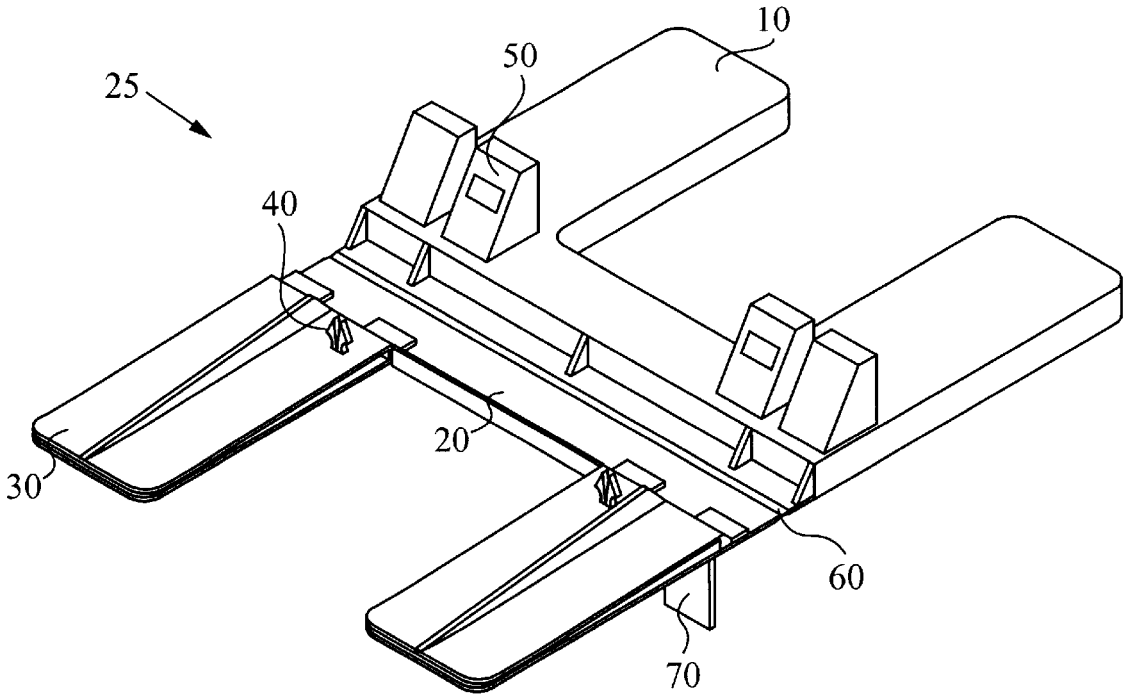
FIG. 1 is a perspective view of the primary support structure of a media stand, in accordance with the instant invention.

FIG. 1 illustrates a perspective view of a primary support structure 25, in accordance with the media stand of the instant invention. The primary support structure 25 preferably comprises a foot member 10, a support member 20, and a hinge member 60. The foot member 10 is preferably a U-shape member, although it is understood that the foot member 10 can be of various shapes and sizes. The support member 20 is also preferably a U-shape member, although it is also understood that the support member 20 can be of various shapes and sizes. The foot member 10 and support member 20 can be coupled to each other by the hinge member 60. The hinge member 60 couples the foot member 10 and the support member 20 in such a way as to form an H-shaped structure in an open position, as shown in FIG. 1. The hinge member 60 is preferably a living hinge. A living hinge is advantageous because it can be simultaneously manufactured with the foot member 10 and support member 20. Additionally, because a living hinge is usually made out of the same material as the foot member 10 and support member 20, it is aesthetically more appealing that a metal hinge or hinges.

The primary support structure 25 of the media support preferably comprises means to secure the foot member 10 and support member 20 in a operational, or upright stand position, for supporting media. The means to secure the foot member 10 and support member 20 in the operational position can include hook and loop fabric combinations, complementary magnets, and hook members that secure the foot member 10 and support member 20 together. Preferably, the securing means comprises one or more two-part snap features 40 and 50, which detachably secure the foot member 10 and the support member 20 in the upright stand position, such as illustrated in the FIG. 6. In the upright stand position, the foot member 10 is adapted to rest on support surface, such as a desk or a table top, while the support member 20 forms an acute angle to the foot member 10 against which a media object can rest. The two-part snap feature preferably include a female snap portion 50 and a male snap portion 40. The female snap portion 50 is preferably a raised cavity located on the top surface of the foot member 10. The male snap portion 40 is preferably a double split hook located on the back surface of the support member 20. Although, it is understood that other well known configurations for snap features can be used.

The primary support structure 25 of the media stand, in accordance with the instant invention comprise an arm feature 70. The arm feature 70 is preferably a protrusion located on the front surface of the support member 20. The arm feature 70 extends substantially perpendicular from the support member 20 and supports media objects on the media stand. In particular the are feature 70 helps to prevent media objects from slipping downward and/or outward from the support member 20. As such, a media object lying on the stand would have its weight distributed along the arm feature 70 and support member 20.

The primary support structure 25, also preferably further comprises of a clamp feature 30. In the upright stand position, (viz, with the support member 20 and the foot member 10 secured through the two-part snap features 40 and 50), the clamp feature 30 can be used to clap media objects thus allowing the support structure 25 to hold or display heavier or larger media object than would otherwise be feasible. Further the clamp feature can help to prevent media from slipping or titling out a secured position on the stand. For example, the clamp feature 30 allows the stand to hold clipboards and books by their front and back covers, which otherwise would fall out of the stand or be unstable on the stand. The clamp feature 30 preferably comprises a thin resilient flap coupled to the support member 20 by method of sonic welding. Although it is understood that the clamp feature 30 can be coupled to the support member 20 in other well known ways. For example, the clamp 30 can be monolithic with the support member 20 and have any number of mechanisms which urge a resilient flap to clamp and secure media objects to or on the stand, with the stand in an upright position.

Figure 2:
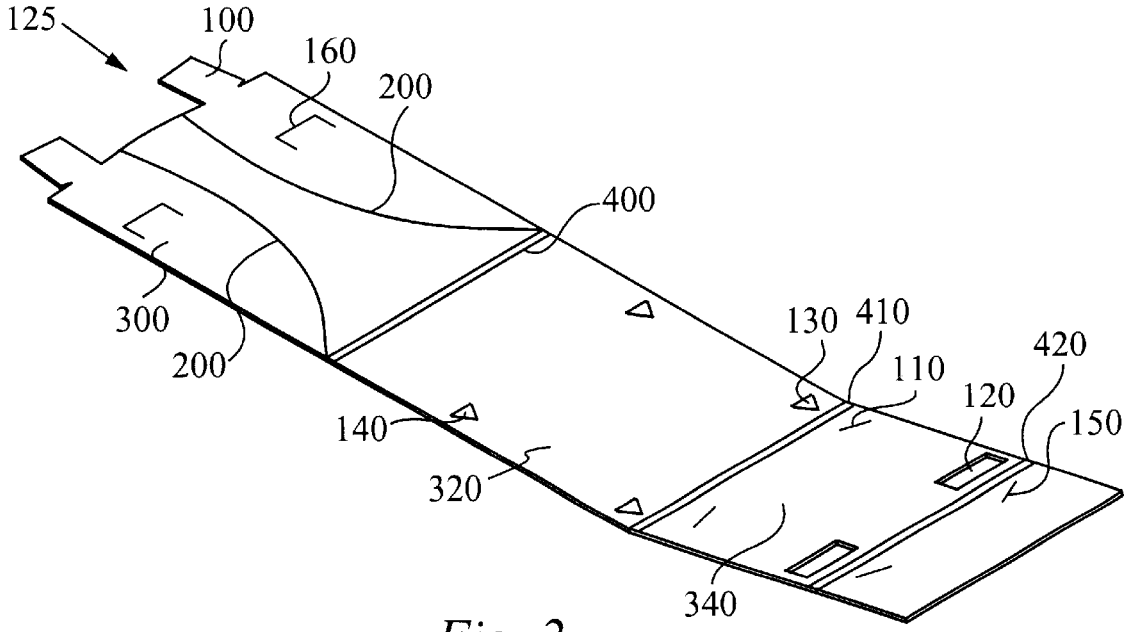
FIG. 2 is a perspective view of a secondary support structure configured to couple with the primary support structure, shown in FIG. 1.
Figure 3:
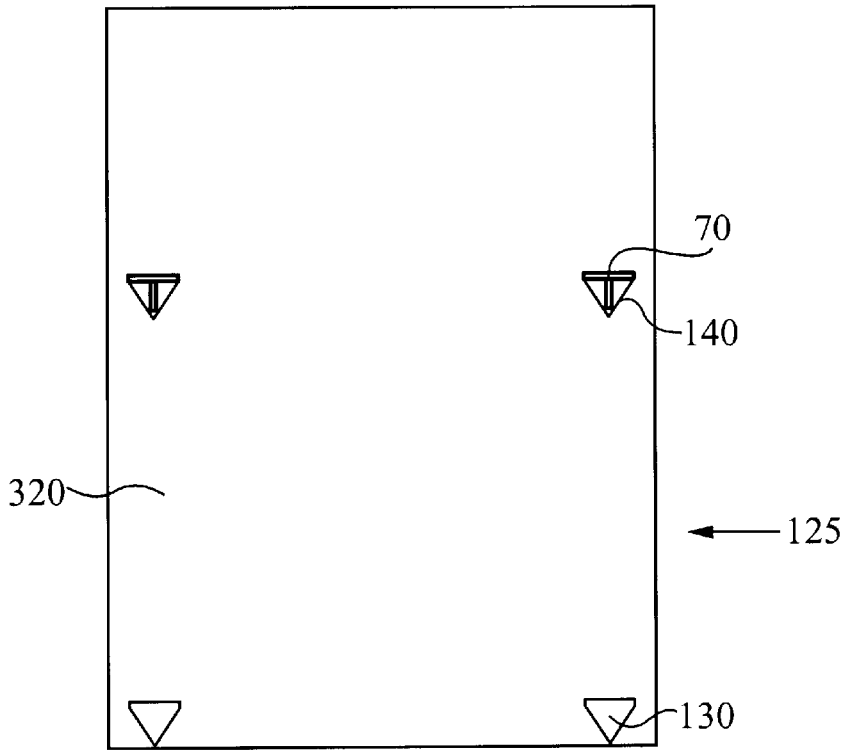
FIG. 3 is a rear view of the secondary support structure in a folded packaging position around the primary support structure.
Figure 4:
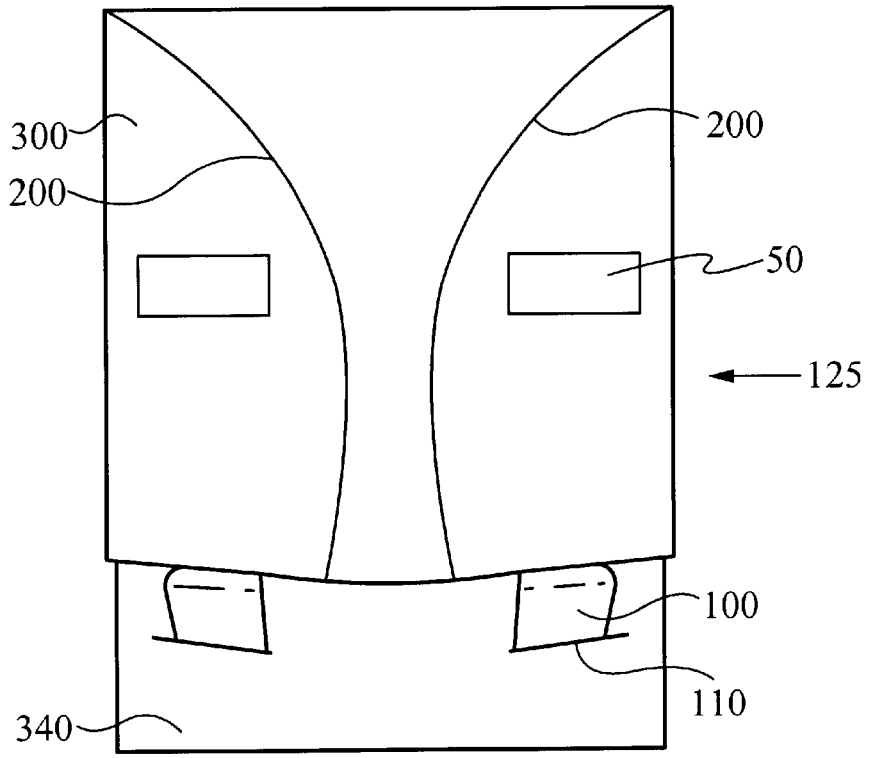
FIG. 4 is a front view of the secondary support structure in a folded packaging position around the primary support structure.

FIG. 2 illustrates a perspective view of secondary support structure 125 of a media stand, in accordance with the preferred embodiment of the instant invention. The secondary support structure 125, also referred to a media content platform, is configured to integrate with the primary support structure 25, illustrated in FIG. 1, and is preferably configured to provide the function of the point-of-purchase packaging for the media display system comprising the primary structure 25 and provide the function of delivering media content, as explained in detail below.

Still referring to FIG. 2, the secondary support structure 125 preferably comprises a top section 300, a middle section 320, and a bottom section 340. Although it is understood that the secondary support structure 125 can have more or less than three sections. The top section 300 preferably has a plurality of curved pleats 200 traversing along the length of the top section 300. This aspect of the invention allows the secondary support structure to fold in such a way as to wrap around the primary support structure 25 and add structural integrity to the media stand with the media stand assembled.

The curved pleats 200, also referred to herein as a paper spine, can have any number of sizes, lengths and configurations, depending on the specific design of the primary support structure 25. The paper spine 200, provides the secondary structure 125 with a high degree of structural integrity. Because of the high degree of structural integrity, provided by the paper spine 200, the secondary structure 125 can be formed solely from a paper material, whereby the secondary structure 125 is assembled and/or integrated with the primary structure 25 using only folds, pleats, slits and tabs thereby greatly reducing the cost and ease with which the secondary structure 125 can be manufactured. Further, because the secondary structure 125 can be formed solely from paper, replacement of the secondary structure with a new secondary structure (not shown), to replenish or replace media content printed or displayed on the secondary structure 125, results in a minimal environmental impact, since the entire secondary structure 125 can be recycled.

The top section 300 preferably has at least one slot 160 which enable the female snap feature 50 to couple with the secondary support structure 125 with the secondary support structure functioning as packaging. Furthermore, the top section 300 is preferably coupled to a flap 100 along an upper edge of the top section 300. The flap 100 is preferably used to secure the secondary support structure 25 in as upright stand position for displaying media objects, while the secondary support structure 125 is wrapped around the primary support structure 25. Additionally, the secondary support structure 125 preferably further comprises of a top fold section 400, a middle fold section 410, and a bottom fold section 420, which further enable the secondary support structure 125 to couple or integrate with the primary support structure 25, as shown in FIG. 1. It will be clear to one skilled in the art that the preferred size of the top fold section 400, middle fold section 410 and bottom fold section 420 will depend on the size, shape and thickness of the primary support structure 25.

Still referring to FIG. 2, a plurality of slots 130 are preferably located on the middle section 320, such as to allow the arm feature 70 of the primary support structure to protrude through the middle section 320 of the secondary support structure 125, with the primary support structure 25 and secondary support structure 125 assemble in the upright stand position for displaying media objects.

The middle section 320, also preferably has a plurality of slots 140 allowing the arm feature 70 that extend through the secondary support structure 125 with the primary support structure 25 and the secondary support structure 125 assembled in a packaging position. Although the arm feature 70, the slots 130 and 140 have a triangular cross sectional area, it is understood that such a cross-sectional area geometry is a matter of choice and other cross-sectional area geometries can be used without departing from the spirit of the invention.

The bottom section 340 has at least one slot 120 and at least one slit 110. When the media stand is assembled in a packaging position, the female snap portion 50 preferably couples to both the slots 120 and 160. However, should the female snap portion 50 be of different size or shape, the slot 120 and the slot 160 can be modified from the preferred embodiment, in order to couple with the female snap portion 50. Additionally, when the primary support structure 25 is couple to the secondary support structure in the packaging position, the flap 100 is preferably coupled to the slit 110.

FIGS. 3–10 illustrate packaging and assembling the a media stand comprising a primary support 25 and secondary support 125, such as those described in detail above. The media support is preferably packed with the primary support wrapped within the secondary support structure 125 in a substantially flat packaging position, such as shown FIGS. 3–4.

To achieve the preferred packaging position the primary support structure 25 is preferably in the open position such a shown in FIG. 1, with the secondary support structure 125 wrapped around the primary support structure 125. To secure the media support in the packaging position, the arm structure 70 is coupled to the slot 130. In this position, the surface of the middle section 320 lies adjacent to the bottom surface of the foot member 10, the front surface of the support member 20, and the front surface of the clamp feature 30. Moreover, in this same configuration, the middle fold section 410 lies adjacent to the front surface of the support member 20 and the surface of the bottom section 340 is wrapped around the primary support structure 25 which lies adjacent to the top surface of the foot member 10, the back surface of the support member 20, and the back surface of the clamp feature 30. As such, the slot 120 is coupled to the female snap portion 50. Additionally, the top section 300 is wrapped around the primary support structure 25 such that it substantially overlaps the bottom section 340, with the slot 160 coupled with the arm extension 70. Finally, to properly secure and primary support structure within the secondary support structure 125, the flap 100 is inserted into to the slit 110. This method enables the secondary support structure 125 to couple to the primary support structure 25 in the packaging position without the aid of tools or other adhesive materials. However, it understood that other methods, well known in the art can be used to secure primary structure to the secondary support structure. For example, the entire stand comprising the primary support structure 25 and the secondary support structure 125 in the packaging position can be wrapped in cellophane or other suitable packaging material.

Figure 5:
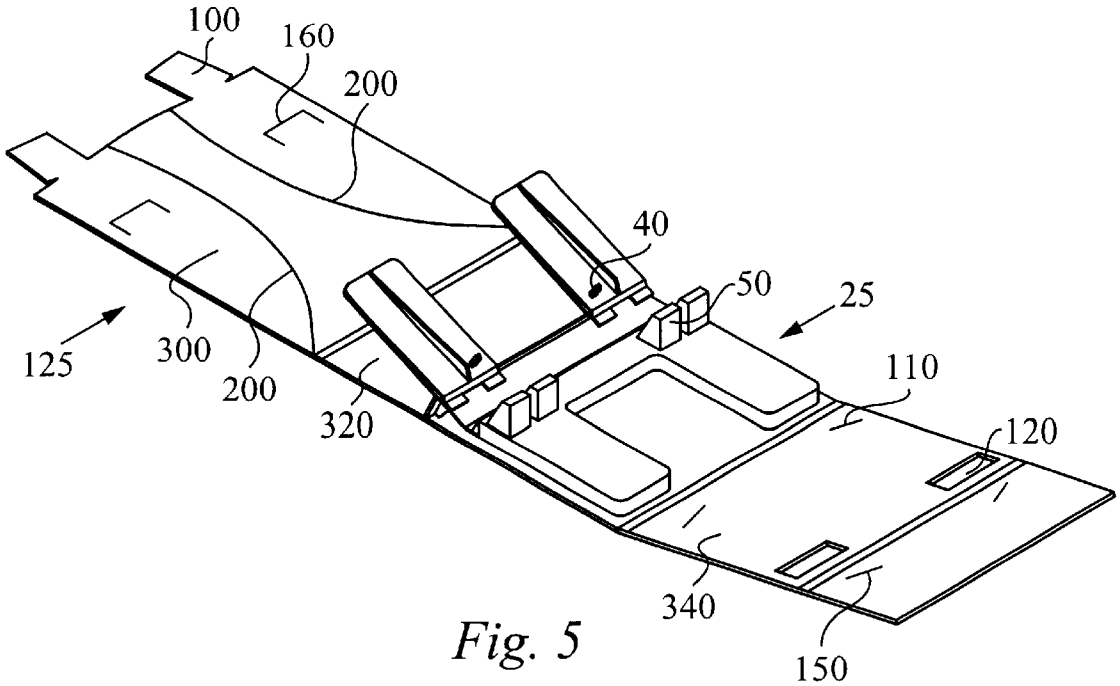
FIG. 5 is a perspective view showing the primary support structure in relation to the secondary support with the secondary support structure unfolded from the packaging position.

In order to assemble the media stand, secondary support structure is opened, such as shown in FIG. 5, and the primary support structure 25 is remove from the secondary support structure 125. The primary support structure 25 is then placed in the upright stand position by opening the foot structure 10 and support structure 20 through hinge member 60 and snapping the male snap portion 40 and female snap portion 50 together, thereby detachably securing the primary support 25 in the upright stand position. The primary support is now capable of displaying or holding media objects of various shapes and sizes. However, preferably the secondary support structure 125 is coupled to or integrated with the primary support structure 25 to the to enhance the stability and functionality of the media stand, as explained below.

Figure 6:
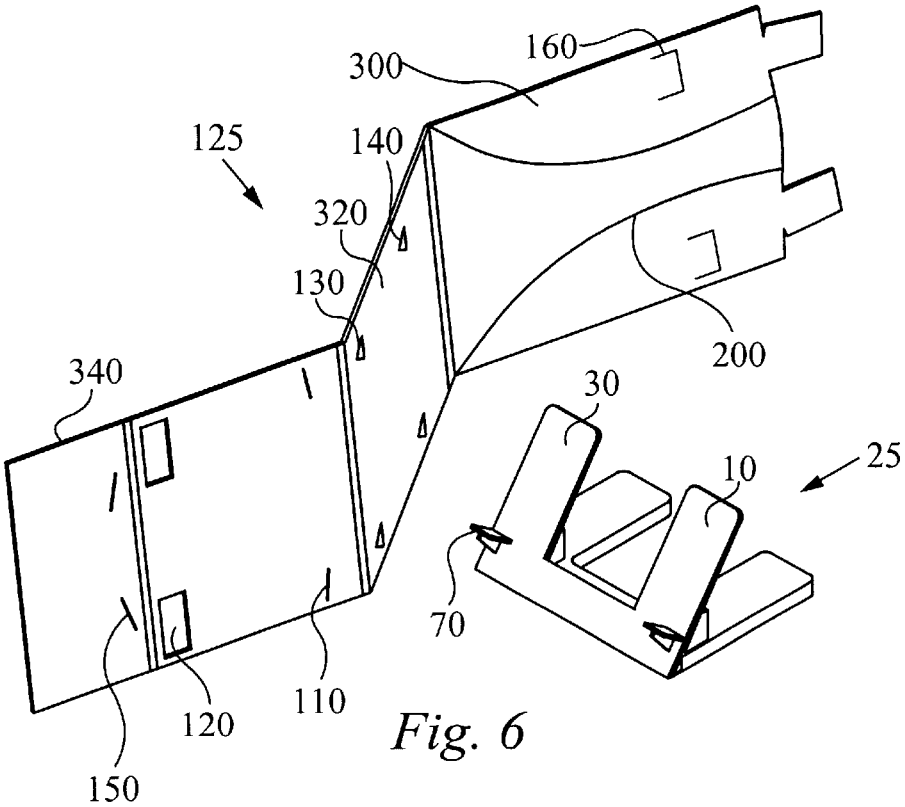
FIG. 6 is a view of the primary support structure and the secondary support structure separated from each other and with the primary support structure secured in a closed upright position.
Figure 7:
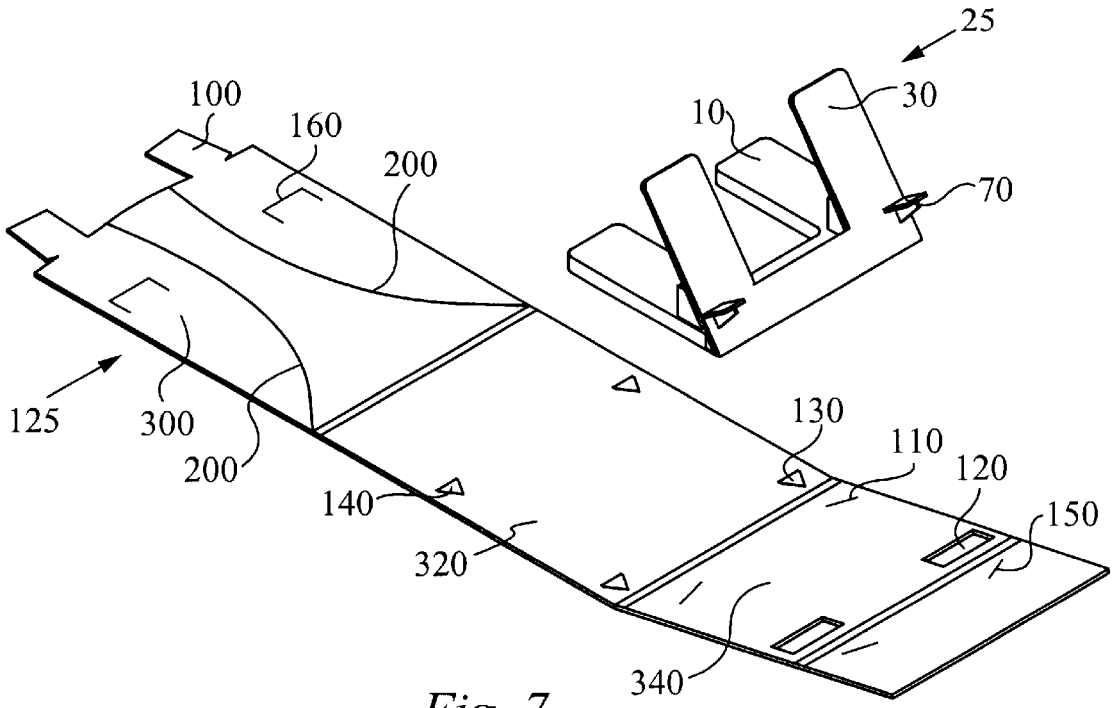
FIG. 7 is a view of the primary support structure rotated into a position to begin the assemble of the media stand.
Figure 8:
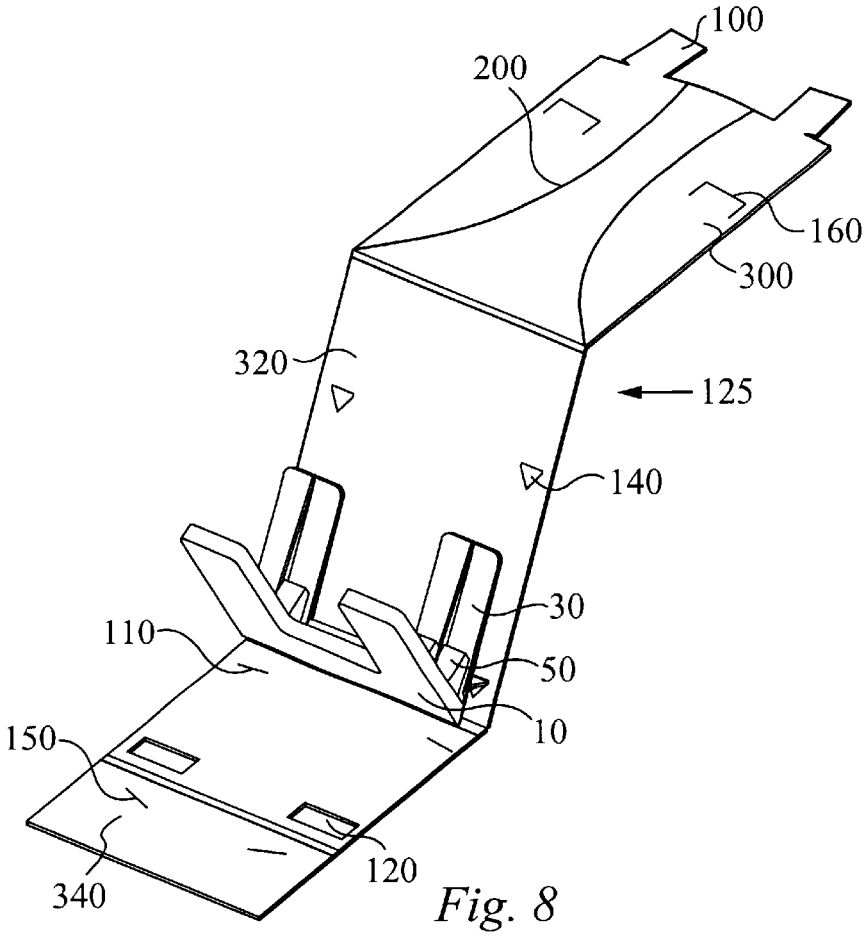
FIG. 8 is a view of the primary support structure and the secondary support structure coupled partially assembled with the primary support secured in the closed upright position.
Figure 9:
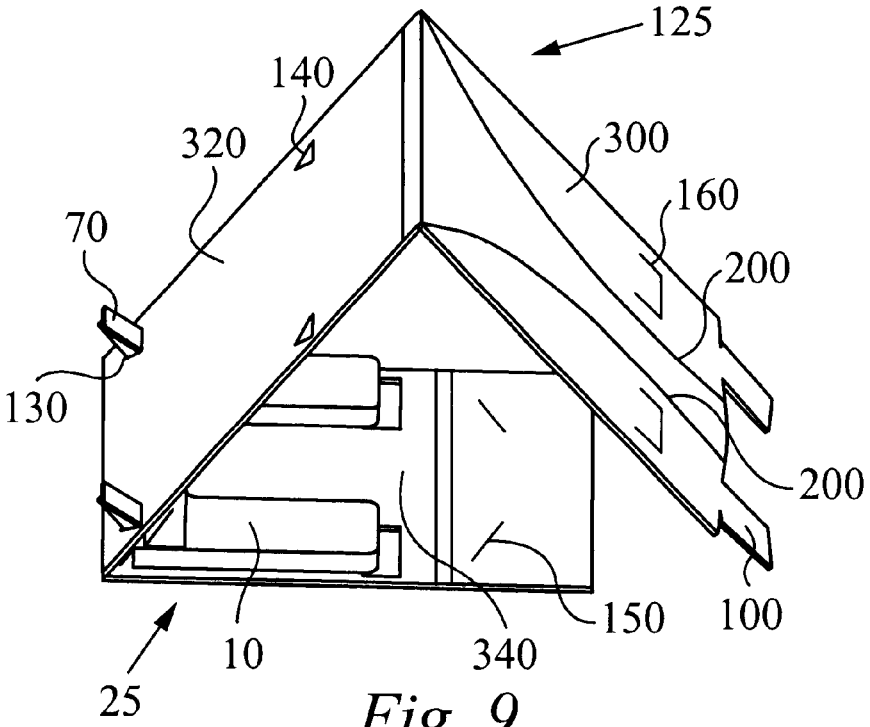
FIG. 9 is a side view of the primary support structure and the secondary support structure partially assembled and in an upright support position.
Figure 10:
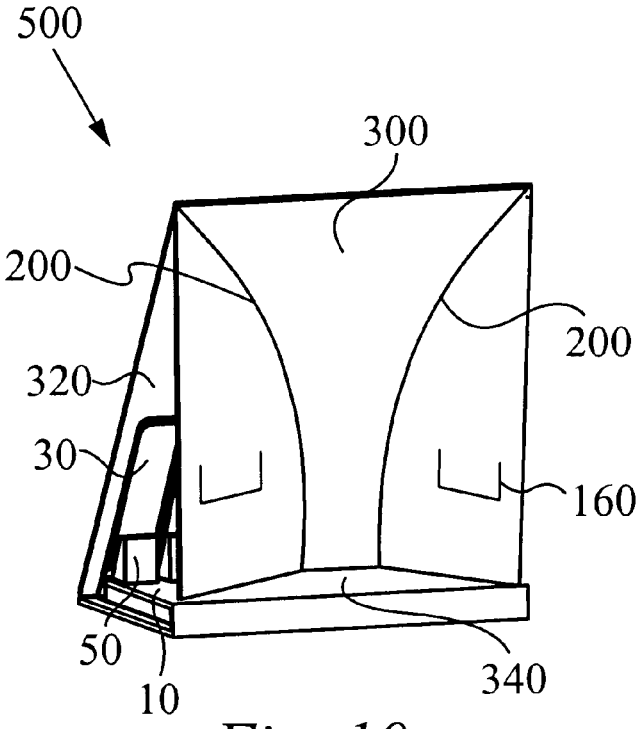
FIG. 10 is a back perspective view of the media stand assembled in an upright position.

Now referring to FIG. 7, the primary support structure 25 is rotated relative to the secondary support structure 125 to a position, such as shown in FIG. 6, whereby bottom section of the foot member 10 is positioned on top of the bottom section 340 of the secondary support structure. The secondary support structure is then folded such that the middle section 320 and middle fold section 410 are positioned on top of the outer surface of the support member 20, such as shown in FIG. 8. During this process, the middle section 320 is secured to the front surface of the support member 20 by positioning the arm extension 70 to the slot 130. Once the middle section 320 is secured to the support member 30, the secondary support structure 125 is further folded such that the top section 300 is substantially vertical, such as shown in FIG. 9. The top section 300 is folded along the curved pleats 200 such that it creates a concave surface and the flaps 100 are inserted into the slits 150, thereby securely coupling the primary support structure 25 and the secondary support structure 125 together and providing a highly functional and portable media stand.

In the upright stand position, the media stand 500 has the shape of a wedge structure. The bottom section 340 is rested on a support surface, with the surface of the middle section

320 having an obtuse angle relative to support surface. The top section 300 is substantially vertical and preferably acts as a column structure, transferring the weight of media objects resting on the middle section 340 to the supporting surface. In yet further embodiments of the invention, the media stand is also a media content distribution system, whereby literature, messages, art work and or logos are printed or displayed for or on one or more surfaces of the media stand. Preferably, the media content is printed or displayed on a visible surface of the secondary support structure 125.

Figure 11:
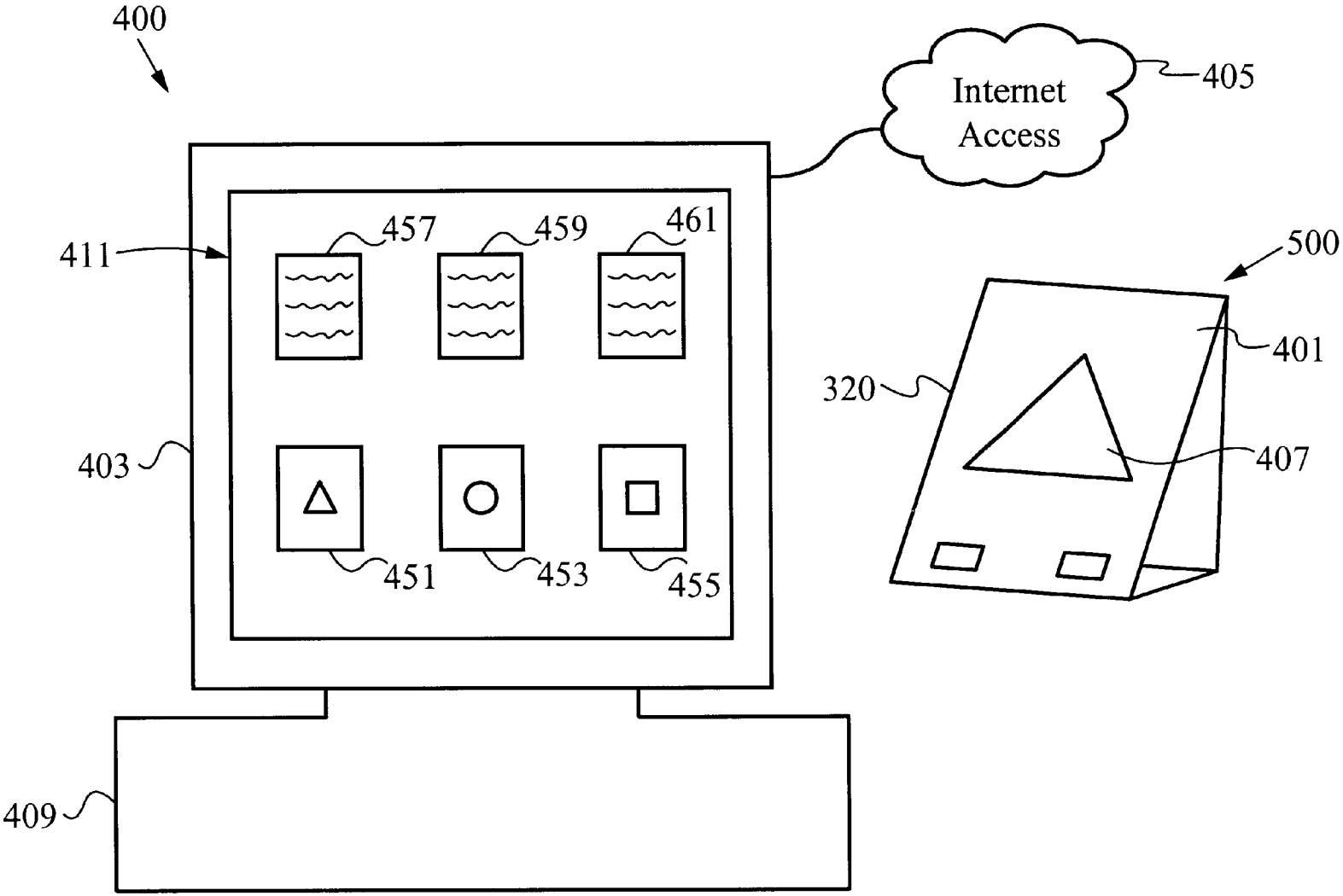
FIG. 11 is a schematic diagram of a media content delivery system which utilizes functional media stand packaging for the distribution of media content, in accordance with the instant invention.

Now referring to FIG. 11, in accordance with the media distribution system of the instant invention, a media content provider selects media content to be displayed on the media stand from a computer 409 that accesses a web-site 411 through internet access 405. Preferably, the media content provider can selected media content from an electronic catalog displaying a number of messages, logos or prints 451, 453, 455, 457, 459, and 461, also referred to herein as content templates. For example, a media content provider can order a number of media stands 500 with the media content selected form the content template 451 to be printed on a surface of the secondary support structure 125. While the media content from the content template 451 can be printed on any visible surface of the secondary support structure 125, it is preferable that media content is printed or displayed on the front surface 401 of the middle section 320 of the secondary support structure 125. Alternatively, or in addition to, printing media content on a surface of the secondary support structure 125, the media content can be printed on a portion of the primary support structure 25, the type of media content that can be displayed by the media stand 500 is unlimited.

In further embodiments of the invention, one or more of the content templates 451, 453, 455, 457, 459, and 461 can be downloaded and added a different design or content template and/or can be modified by the media content provider using drawing, artwork or other suitable software supported through the computer 409 or the web-site 411. In yet further embodiments, media content is completely customized and created by the content providers either on the computer 409 or at the web-site 411.

Regardless of how the design of the media content is chosen, submitted or printed, media content that is displayed or supported by the media stand of the instant invention can preferably be replenished by replacing the secondary support structure, also referred to herein as a media content platform which is printed with new media content. Alternately, media content that is displayed or supported by the media stand can be replenished by the replacement of a portion of the secondary support structure. For example, the secondary support structure or media content platform can be configured with a fixture, such as a clear slip-in envelop fixture, whereby the new media content is printed on a sheet of paper which is then placed within the clear slip-in envelope fixture in order to be displayed. It will be clear to one skilled in the art that any other number of suitable fixtures can be used to attach and/or secure new media content displayed onto a portion of the media stand of the instant invention.

In a preferred method of the instant invention, a content provider orders a replacement design to be displayed on new secondary support structures, whereby the new secondary support structure are distributed to be assembled with, or integrated with existing primary support structures or portable media stands, thereby replenishing the content data that displayed on the media stands.

The multi-functional media stand 500, coined the CreatorKiosk, can be used to display any number of media objects, such as magazines, folders, envelopes, photographs, clipboards, books, papers and other media objects. At least a portion of the media stand preferably provides a packaging function, a support function and a media content delivery 10 function. The CreatorKiosk media stand can be customized in any number of ways. For example, customers and businesses can place contact information, relevant personal information, and references to materials on one or more portions of the media stand 500. The CreatorKiosk provides businesses with the ability to distribute target advertisement and messages to a target audience which is likely to frequently view the target advertisement and messages.

The present invention has been described in terms of specific embodiments incorporating details to facilitate the understanding of the principles of construction and operation of the invention. As such, references, herein, to specific embodiments and details thereof are not intended to limit the scope of the claims appended hereto. It will be apparent to those skilled in the art that modifications can be made in the embodiment chosen for illustration without departing from the spirit and scope of the invention.

I claim:

1. A stand for supporting a media object comprising:

a. a primary support structure comprising:
   i. a support member; and
   ii a foot member configured to be secured to the support member in an upright stand position, such that the media object can be supported on the support member in the upright stand position with the foot member resting on a support surface; and b. a secondary support structure comprising a plurality of panels configured to wrap around the primary support structure and provide surface area for supporting the media object with the primary support structure in the upright stand position.

2. The stand of claim 1, wherein the support member and the foot member are capable of being placed in a flatted packaging position and wherein the secondary structure is configured wrap around and package the primary support structure with the primary support structure in the flatted packaging position.

3. The stand of claim 1, wherein the support member and the foot member are hingably coupled to switch between the upright stand position and the flatted packaging position.

4. The stand of claim 1, wherein the support member and the foot member are configured to be secured in the upright stand position through one or more two-part snap features.

5. The stand of claim 1, wherein the support member comprises one or more arm structures for supporting the media object in the upright stand position.

6. The stand of claim 1, wherein the primary structure further comprises a clasping feature for securing the media object.

7. A stand for supporting a substantially planar object, the stand comprising:

a. at least one foot member and an upstanding portion configured at an angle to the foot member for resting the planar object on a frontal face of the upstanding portion; and b. at least one platform coupled to the frontal face of the upstanding portion, such that the relative angle between the frontal face and the platform is substantially perpendicular; and c. a secondary support structure comprising:

i. a sheet material having a plurality of fold lines to form a plurality of panels; and ii. a plurality of slots located on the sheet material;

wherein a first panel is adapted to lie adjacent to the frontal face and a second panel is adapted to reasonably be fixed relative to the foot such that the first panel provides expanded support for the planar object and the second panel supports the first panel.

8. The stand of claim 7, wherein the platform has grooves parallel to the outer surface of the clamps such that it prevents the planar object from slipping out of the stand.

9. The stand of claim 7, wherein the sheet material comprising:

a first panel for increasing the support area of the first body section; and a second panel providing structural support to the first panel, such that some of the load applied on the first panel can be transferred to the second body section.

10. The stand of claim 7, wherein the first panel is secured to the first body section by means of friction with a surface of the arm feature.

11. The stand of claim 7, wherein the first panel is secured to the first body section by attaching the first panel to the arm feature.

12. The stand of claim 7, wherein the first panel is secured to the first body section by coupling a slot in the first panel with the arm feature.

13. The stand of claim 7, wherein the second panel has a plurality of flaps, such that the second panel can be secured to the second body section by coupling the flaps to the second body section.

14. The stand of claim 7, wherein the second panel has a plurality of flaps, such that the second panel can be secured to the second body section by coupling the flaps to a plurality of slits in the second body section.

15. The stand of claim 7, wherein the second panel has a plurality of flaps, such that the second panel can be secured to the second body section by inserting the flaps in a plurality of slots located on a third panel of the sheet material, such that the third panel is attached to a foot member.

16. A stand for supporting a substantially planar object, the stand comprising:

a. a main support structure comprising:

i. a first body section having a first body inner surface and a first body outer surface; and ii. a second body section having a second body inner surface and a second body outer surface;

wherein the first body section and the second body section are hingably coupled along an edge of the first body section and an edge of the second body section, such that the main support structure configured to be placed in a supporting position, with the inner surface of the first body section and the inner surface of the second body section being adjacent and at a predetermined angle relative to each other; and iii. at least one arm feature coupled to the outer surface of the first body section; and iv. at least one connector for securing the first body section and second body section in a supporting position, such that the outer surface of the second body section provides support for the stand on a working surface, and the arm feature provides support for printed media with the first body section and the second body section in the closed position; and b. a secondary support structure comprising:

i. a sheet material having an inner surface and an outer surface; and ii. a plurality of slots located on the sheet material; and iii. a plurality of folds across the sheet material;

wherein the outer surface of the sheet material is coupled to the outer surface of the first body section by folding the secondary support structure along the folds and the arm feature of the main support structure, such that it provides a greater surface area to support the planar object.

17. The stand of claim 16, wherein the arm feature has grooves parallel to the outer surface of the clamps such that it prevents the planar object from slipping out of the main support structure.

18. The stand of claim 16, wherein the connector is comprised of:

a. a first snap feature having a split double hook, protruding from the inner surface of the clamps; and b. a second snap feature having a cavity in a protrusion located on the second body section of the main support structure;

wherein the first body section and the second body section of the main support structure are secured together by inserting the first snap feature into the second snap feature.

19. The stand of claim 16, wherein the second snap feature is molded at an angle such that the second snap feature provides support to the first body section and maintains a pre-determined angle between the first body section and the second body section when they are secured together.

20. The stand of claim 16, wherein the sheet material comprising:

a. a first panel for increasing the support area of the first body section; and b. a second panel to provide structural support to the first panel, such that some of the load applied on the first panel can be transferred to the second body section.

21. The stand of claim 16, wherein the first panel is secured to the first body section by means of friction with a surface of the arm feature.

22. The stand of claim 16, wherein the first panel is secured to the first body section by attaching the first panel to the arm feature.

23. The stand of claim 16, wherein the first panel is secured to the first body section by coupling a slot in the first panel with the arm feature.

24. The stand of claim 16, wherein the second panel has a plurality of flaps, such that the second panel can be secured to the second body section by coupling the flaps to a slit in the second body section.

25. A display board complimenting a book stand comprising:

a. a single sheet having an inner surface and an outer surface; and b. a plurality of fold lines traversing across a width of the single sheet;

wherein a first fold line divides the single sheet into a column section and a second section, and a second fold line further divides the second section into a support section and a base section, such that the display is adapted to be folded into a free-standing position; and c. a plurality of longitudinal curved fold lines located along the column portion of the single sheet such that the single sheet can be folded into the free-standing position;

wherein the curved fold lines are folded, creating a concave outer surface of the column section, such that the column section structurally supports the support section of the sheet material; and d. at least one connector for attaching the column section of the single sheet to the base section of the single sheet such that the display board can be in the free-standing position.

26. The display board in claim 25, wherein the connector is comprised of:

a. a plurality of flaps extending from the column section of the single sheet; and b. a plurality of slits located on the base section of the single sheet;

wherein the flaps are inserted in the slits for securing the display board into the free-standing position.

27. The display board of claim 25, wherein the free-standing position provides support for a planar object, such that the base section supports the support section, and the column section transfers a structural load from the support section to the base section.

28. The display board of claim 25, wherein the display board can be attached to a book stand such that it provides additional structural support for a planar object.

29. The display board of claim 25, wherein the single sheet has a plurality of slots, such that the display board can be coupled to a book stand.

30. The display board in claim 25, wherein the base section can be coupled to a base member of a book stand.

31. The display board in claim 25, wherein the support section has slots, such that it can be coupled to a support member of a book stand such that it provides an extended support area for the planar object.

32. The display board in claim 25, wherein the column section can be coupled to the support member of the book stand and the base member of the book stand such that it reinforces the stability and strength of the book stand.

* * * * *

UNITED STATES PATENT AND TRADEMARK OFFICE

CERTIFICATE OF CORRECTION

PATENT NO. : 6,488,251 B1
DATED : December 3, 2002
INVENTOR(S) : Erick Mott

It is certified that error appears in the above-identified patent and that said Letters Patent is hereby corrected as shown below:

Title page,
Item [76], replace the inventor residence "P.O. Box 1737, Palo Alto, CA (US) 94302" with -- Burlingame, CA --.

Column 8,
Line 6, replace "media content delivery 10" with -- media content delivery --.

Signed and Sealed this

First Day of April, 2003

JAMES E. ROGAN
*Director of the United States Patent and Trademark Office*